United States Patent [19]

Smith et al.

[11] Patent Number: 5,022,016

[45] Date of Patent: Jun. 4, 1991

[54] DISPLAY CLOCK

[76] Inventors: Deborah A. Smith; Bryan R. Smith, both of 649-90th La. NE., Blaine, Minn. 55434

[21] Appl. No.: 527,580

[22] Filed: May 23, 1990

[51] Int. Cl.[5] ..... G04B 19/00; G04B 37/00

[52] U.S. Cl. ..... 368/223; 368/317; 40/152.1

[58] Field of Search ..... 368/10, 88, 223, 228, 368/232-238, 276, 278, 285, 316-317; 40/107, 120, 122, 152, 152.1

[56] References Cited

U.S. PATENT DOCUMENTS

| | | | |
|---|---|---|---|
| 2,044,314 | 6/1936 | Mattman | 368/316 |
| 2,069,894 | 2/1937 | Mattman | 368/317 |
| 2,462,598 | 2/1949 | Blodget | 40/120 |
| 3,280,492 | 10/1966 | Nichols | 40/120 |
| 3,817,022 | 6/1974 | Swartz | 368/41 |
| 3,992,872 | 11/1976 | Stanish | 58/50 |
| 4,242,817 | 1/1981 | Ballard | 40/152.1 |
| 4,506,993 | 3/1985 | Brown | 368/276 |

*Primary Examiner*—Vit W. Miska

[57] ABSTRACT

A clock with an area (12*b*) for a display item. The frame (11) is made of a flexible, durable transparent material, so that the display item may be changed with ease. The clock hands (15*a*) and (15*b*) are on the outside of the unit to facilitate the setting of the clock and if needed, the replacement of clock hands (15*a*) and (15*b*).

2 Claims, 3 Drawing Sheets

DISPLAY CLOCK

BACKGROUND

1. Field of Invention

This invention relates to clocks and frames, specifically the combination of a clock with an area where a changeable picture or advertisement can be inserted.

2. Description of Prior Art

Inventors have come up with types of clocks that are used in advertisement. U.S. Pat. No. 3,817,022 (Swartz) 1974 and U.S. Pat. No. 3,992,872 (Stanish) 1976 are examples of these types of clocks. In both cases the clocks are illuminated requiring connection to an electrical outlet. The Swartz requires a special panel with information and clock numbers printed on it. The Stanish has the information printed on an overlay.

OBJECTS AND ADVANTAGES

Accordingly, several objects and advantages for our invention are:

a) to provide a clock which can be placed on a desk or counter without the need for an electrical connection (It is battery operated)

b) that the picture or advertisement is placed between transparent material thus keeping the advertisement or picture clean c) that the transparent frame is easy to clean and is very durable.

d) that the advertisement or picture is very easy to change merely sliding the advertisement behind the insert.

e) the clock hands are on the outside of the clock making it easier to replace hands to match decor.

Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1A:
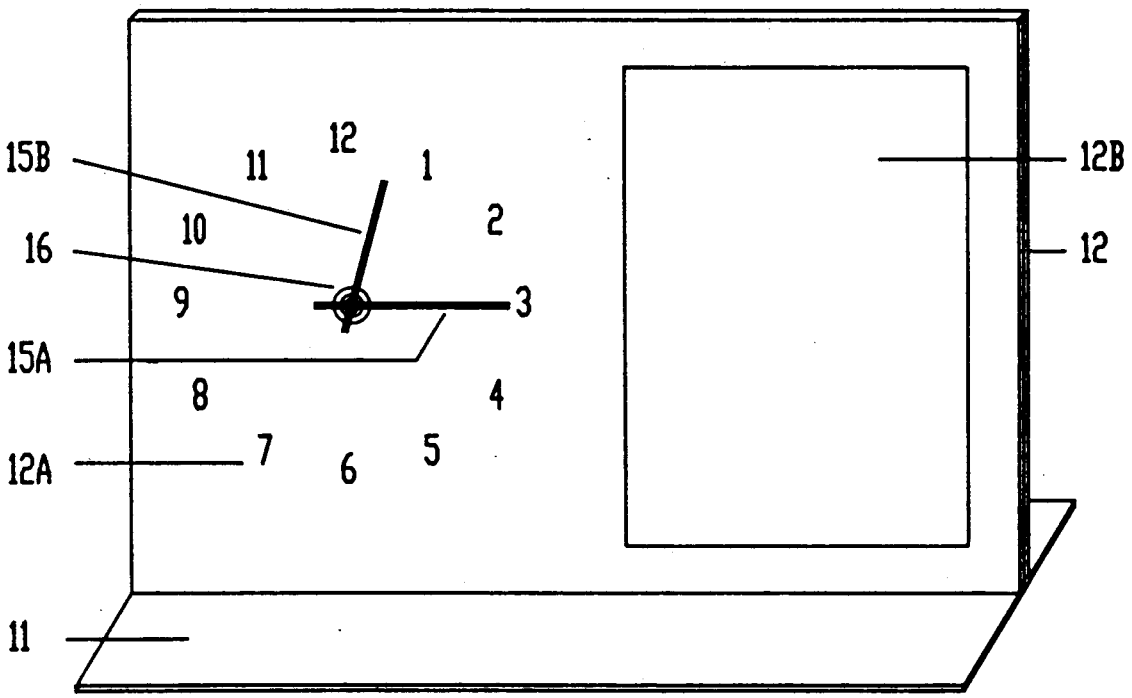
FIGS. 1A to 1C show various aspects of a Display Clock.

In the drawings, closely related parts have the same number but different alphabetic suffixes.

11-Transparent Frame

12-An Insert **12*a*-Clock Face 12*b***-Display Opening

13-Clock Motor

14-Nut

15-Clock Hands **15*a*-Minute Hand 15*b***-Hour Hand

16-Close Nut

17-Battery

Figure 1B:
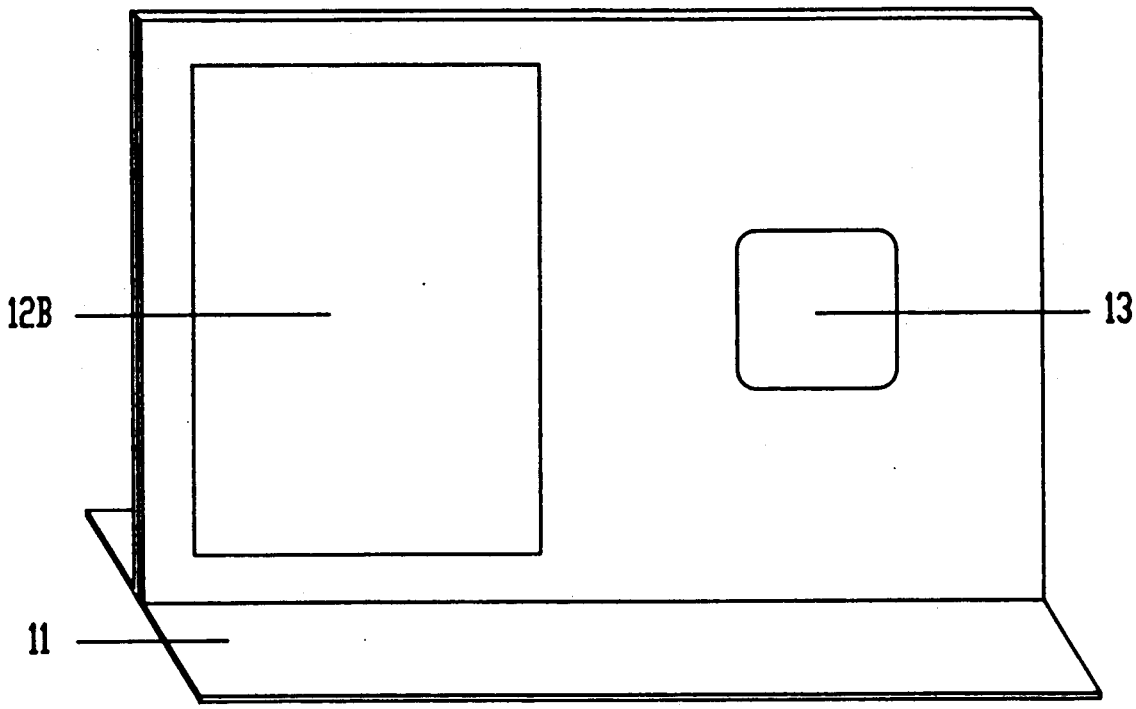
Figure 1C:
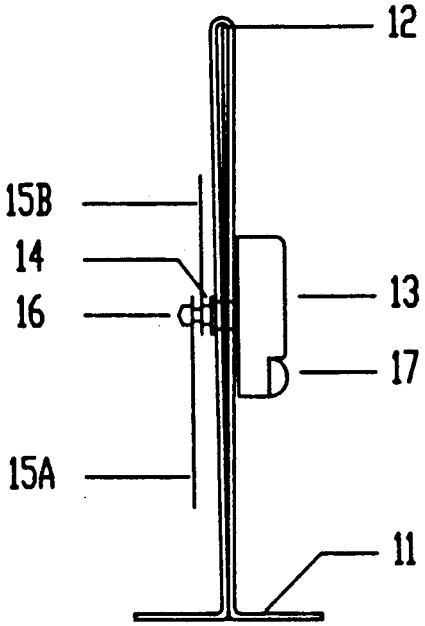
Figure 2:
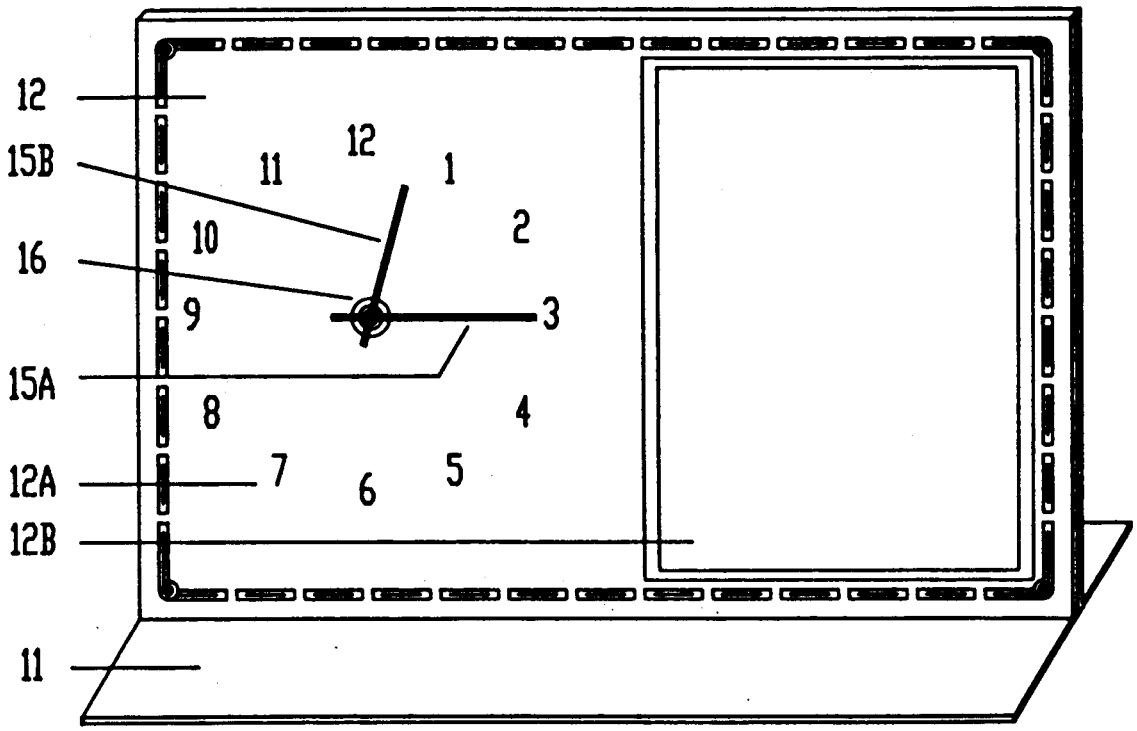
FIG. 2 shows a Display Clock with a border around the Insert.

DESCRIPTION - FIGS. 1A to 1C

A typical embodiment of this invention is illustrated in FIGS. 1A through 1C. The frame 11 itself is made of one large piece of a flexible, transparent material which is heated and bent in half to form an approximately 185 angle on the top. The two sides taper off until they touch about half way from the bottom. About two inches from the bottom, the sides are bent at 90 angles in opposite directions from each other to form the supports (feet) for the frame 11. A hole approximately

3/16" in diameter is drilled through both sides of the frame 11.

The Insert 12 can be any color with a clock face **12*a* of a contrasting color and a 3/16" hole that corresponds to the hole in the frame 11. The insert 12 also has a hole, called a display opening 12*b*** which is used for the display item.

The insert 12 is slid between the front and back of the frame 11 in a manner which allows the 3/16" hole in the frame 11 and the 3/16" hole in the insert 12 to line up.

The clock motor 13 shaft is inserted through the 3/16" hole, so that the motor is to the back of the frame 11. The clock numerals on the insert 12 are to the front of the unit. The clock motor 13 is attached to the frame 1 with a nut 14.

The clock hands 15 are then installed on the clock motor 13 shaft. The hour hand **15*a* is snapped on to the shaft and the then the minute hand 15*b* is held into place with a closed nut 16**.

Operation-FIG. 1A

A AA battery 17 is inserted into the Open area in the back of the clock motor 13. The clock **12*a* can either be set by the control on the back of the clock motor 13 or by gently rotating the clock hands 15*a* and 15*b*** to the correct time.

Any flat display item, e.g. a picture, advertisement, or mirror can be slipped between the front and back of the frame 11, behind the insert 11 and centered in the opening **12*b* in the insert 12. The pressure of the frame 11** will keep the item in place.

The display item may be replaced at any time merely by sliding out the item in place and replacing it with any other item chosen that will fit.

SUMMARY, RAMIFICATION, AND SCOPE

Accordingly, the reader will see that this display clock can be used to display pictures, any advertisement or a mirror and that these items may be changed with relative ease. Furthermore, the display clock has the additional advantages in that:

it permits various colors and designs of clock hands which can be replaced with the removal of one nut.

- it permits a change in colors and designs of the insert using the same die. These inserts can be varied to match any decor.
- it allows the owner of a unit to save space by having a combination clock and picture frame in one compact unit.

The above description should not be construed as limiting the scope of the invention but as merely providing an illustration of the presently preferred embodiment of this invention.

Thus the scope of the invention should be determined by the appended claims rather than by the example given.

I claim:

1. A display device comprising:

a sheet of transparent, bendable material bent to define opposing sides with a space therebetween;

an opening formed through both said opposing sides;

means integrally formed from said sheet to define support feet extending from said opposing sides;

an insert corresponding in size to one of said opposing sides having and aperture therethrough, and containing time indicia surrounding said aperture, said insert further including an opening therein for displaying an additional item;

said insert being placed in said space defined between said opposing sides with the aperture aligned with the opening in said opposing sides;

a timepiece mechanism attached to one of said opposing sides and including a shaft means extending through said opening in said opposing sides;

an hour hand and a minute hand attached to said shaft means for indicating time.

2. A display device as claimed in claim 1 wherein said insert has a border printed around the edge thereof and around said opening.

* * * * *